US005583518A

United States Patent [19]

Nariyama

[11] Patent Number: 5,583,518

[45] Date of Patent: Dec. 10, 1996

[54] STRUCTURE FOR MOUNTING A RETRACTABLE ANTENNA ON A PORTABLE RADIO COMMUNICATION APPARATUS

[75] Inventor: Satoshi Nariyama, Tokyo, Japan

[73] Assignee: NEC Corporation, Tokyo, Japan

[21] Appl. No.: 344,671

[22] Filed: Nov. 21, 1994

[30] Foreign Application Priority Data

Dec. 28, 1993 [JP] Japan ..... 5-336196

[51] Int. Cl.[6] ..... H01Q 1/24

[52] U.S. Cl. ..... 343/702; 343/901

[58] Field of Search ..... 343/702, 895, 343/900, 901; H01Q 1/24

[56] References Cited

U.S. PATENT DOCUMENTS

| | | | |
|---|---|---|---|
| 3,946,317 | 3/1976 | Ishimaru et al. | 343/702 |
| 3,946,390 | 3/1976 | Alexander et al. | 343/702 |
| 4,313,119 | 1/1982 | Garay et al. | 343/702 |
| 4,385,849 | 5/1983 | Crain | 343/901 X |
| 4,725,845 | 2/1988 | Phillips | 343/702 |
| 4,847,629 | 7/1989 | Shimazaki | 343/901 |
| 5,243,355 | 9/1993 | Emmert et al. | 343/895 |

FOREIGN PATENT DOCUMENTS

| | | | |
|---|---|---|---|
| 729186 | 7/1932 | France | 343/901 |
| 2123103 | 10/1990 | Japan . | |

*Primary Examiner*—Donald T. Hajec
*Assistant Examiner*—Tho Phan
*Attorney, Agent, or Firm*—Whitham, Curtis, Whitham & McGinn

[57] ABSTRACT

A structure including a casing allows the user of a portable radio communication apparatus to extend and retract a retractable antenna into the casing of the apparatus with the hand holding the casing. The casing has thereinside a movable contact, a locking portion, an electrode, and a resilient member having a spring. An operating portion for operating the movable contact protrudes from the casing and is connected to the movable contact. To extend the antenna from the casing, the user tilts the casing such that the antenna is oriented downward and then presses the operating portion. As a result, the movable contact is moved away from the locking portion to allow the antenna to fall due to gravity. To retract the antenna into the casing, the user tilts the casing such that the antenna is oriented upward and then presses the operating portion.

12 Claims, 4 Drawing Sheets

STRUCTURE FOR MOUNTING A RETRACTABLE ANTENNA ON A PORTABLE RADIO COMMUNICATION APPARATUS

BACKGROUND OF THE INVENTION

The present invention relates to a retractable antenna for a portable radio communication apparatus and, more particularly, to a structure for allowing the antenna to be extended from and retracted into the casing of the apparatus at the outside of said casing.

It has been customary with an antenna of the kind described to hold the casing of a portable radio communication apparatus by one hand and extend or retract the antenna by nipping the tip of the antenna by the other hand. The antenna is provided with a round metallic feed point at the innermost end thereof, and a projection inboard of the feed point. The antenna is guided into and out of the casing by an antenna guide. A flexible metallic contact is affixed to the top of the casing. When the feed point of the antenna is brought into contact with the metallic contact, a carrier coming in through the antenna is delivered to a receiver section built in the casing.

When the antenna is extended from the casing, the feed point of the antenna forces the flexible metallic contact to open. When the projection of the antenna abuts against the contact, the feed point is locked. To retract the antenna into the casing, the antenna is pushed into the casing along the antenna guide with the result that the flexible metallic contact is restored to the original position.

A structure for mounting a retractable antenna of the type described is disclosed in, for example, Japanese Utility Model Laid-Open Publication No. 2-123103 (Oct. 9, 1990). The structure taught in the Laid-Open Publication includes a curved guide in order to surely receive an antenna in a casing, thereby eliminating noise due to vibration or similar cause.

In the conventional structure described above, when the antenna is extended from the casing, it is locked by the engagement of the metallic contact of the casing and the feed point of the antenna. This brings about a problem that the user of the apparatus has to nip the tip of the antenna and pull it out with one hand while holding the casing with the other hand. Specifically, when the user is holding, for example, baggage with one hand, the user cannot extend the antenna from the casing.

SUMMARY OF THE INVENTION

It is, therefore, an object of the present invention to provide a structure which allows an antenna to be extended from and retracted into a casing by one hand.

It is another object of the present invention to provide a structure which prevents an antenna from jumping out or slipping out of a casing when extended.

In accordance with the present invention, an antenna mounting structure includes a movable contact and a locking portion cooperating to lock a retractable antenna in position. A resilient member is held in contact with the movable member. A device is provided for operating the movable contact at the outside of a casing. A signal coming in through the antenna is delivered via an electrode. To extend the antenna from the casing, the user tilts the casing downward and then operates the operating device with the hand holding the casing. As a result, the movable contact is moved. When the antenna is extended from the casing, a flange provided on the innermost end of the antenna abuts against the locking portion. This prevents the antenna from jumping out or slipping out of the casing.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
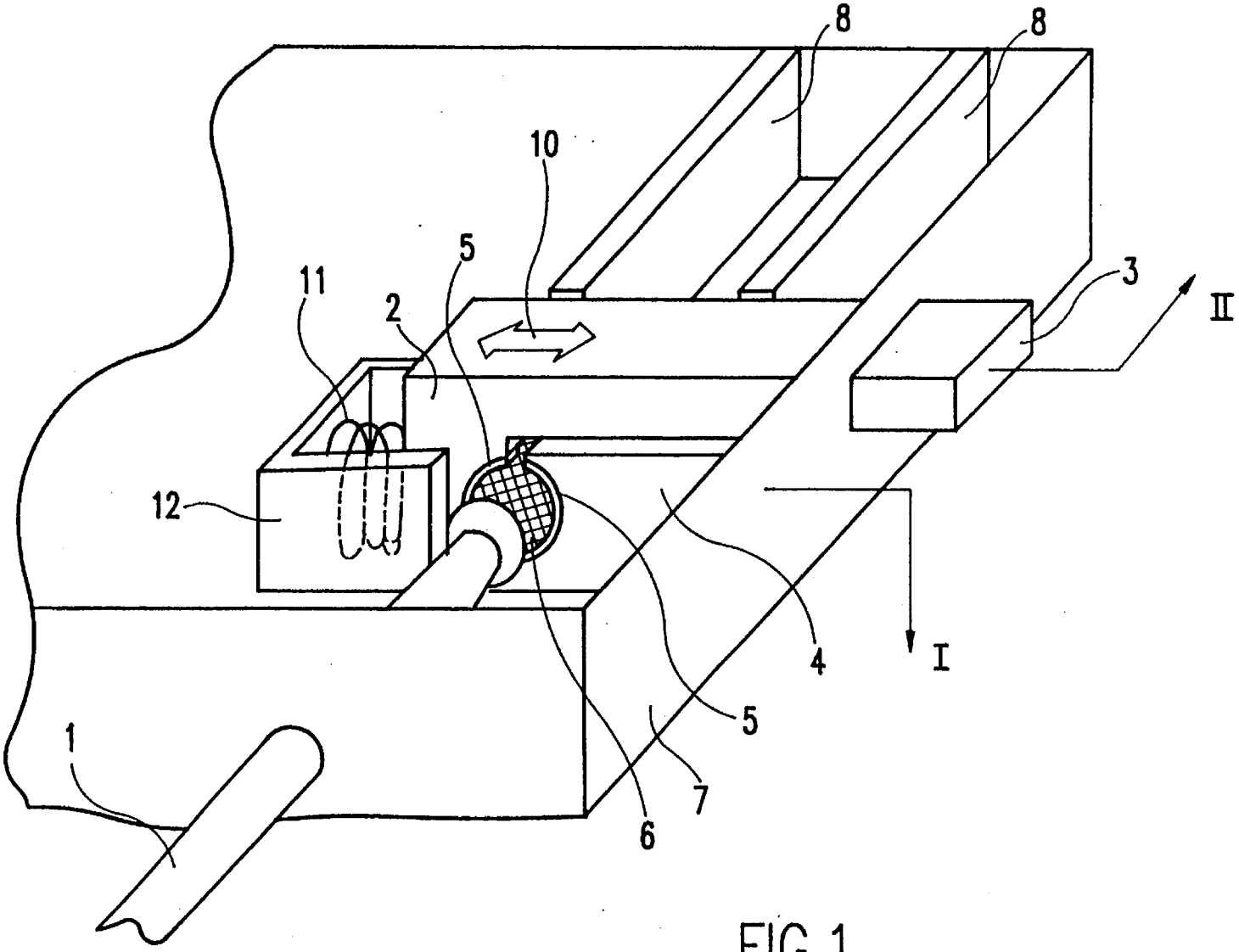
FIG. 1 is a perspective view showing an antenna mounting, structure embodying the present invention.

Referring to FIG. 1 of the drawings, a portable radio communication apparatus with an antenna mounting structure embodying the present invention is shown. As shown, the apparatus has a casing 7 and an antenna 1 retractably mounted on the casing 7. The antenna 1 has a round conductive feed point 6 while the casing 7 has a movable contact 2. The movable contact 2 allows the antenna 1 to be moved into and out of the casing, as will be described later specifically. An operating portion 3 is connected to the movable contact 2 and protrudes to the outside of the casing 7. The movement of the movable contact 2 is guided by a contact guide 12. A spring 11 is received in the contact guide 12 and anchored at opposite ends thereof to the guide 12 and movable contact 2, as illustrated. The casing 7 includes a locking portion 4 for locking the antenna 1 when the antenna 1 is extended from the casing 7. The movable contact 2 and locking portion 4 are each provided with an electrode 5 for feeding a signal coming in through the antenna 1 to a receiver section built in the casing 1. Antenna guides implemented as 8 guide the antenna 1 into and out of the casing 7.

Figure 2:
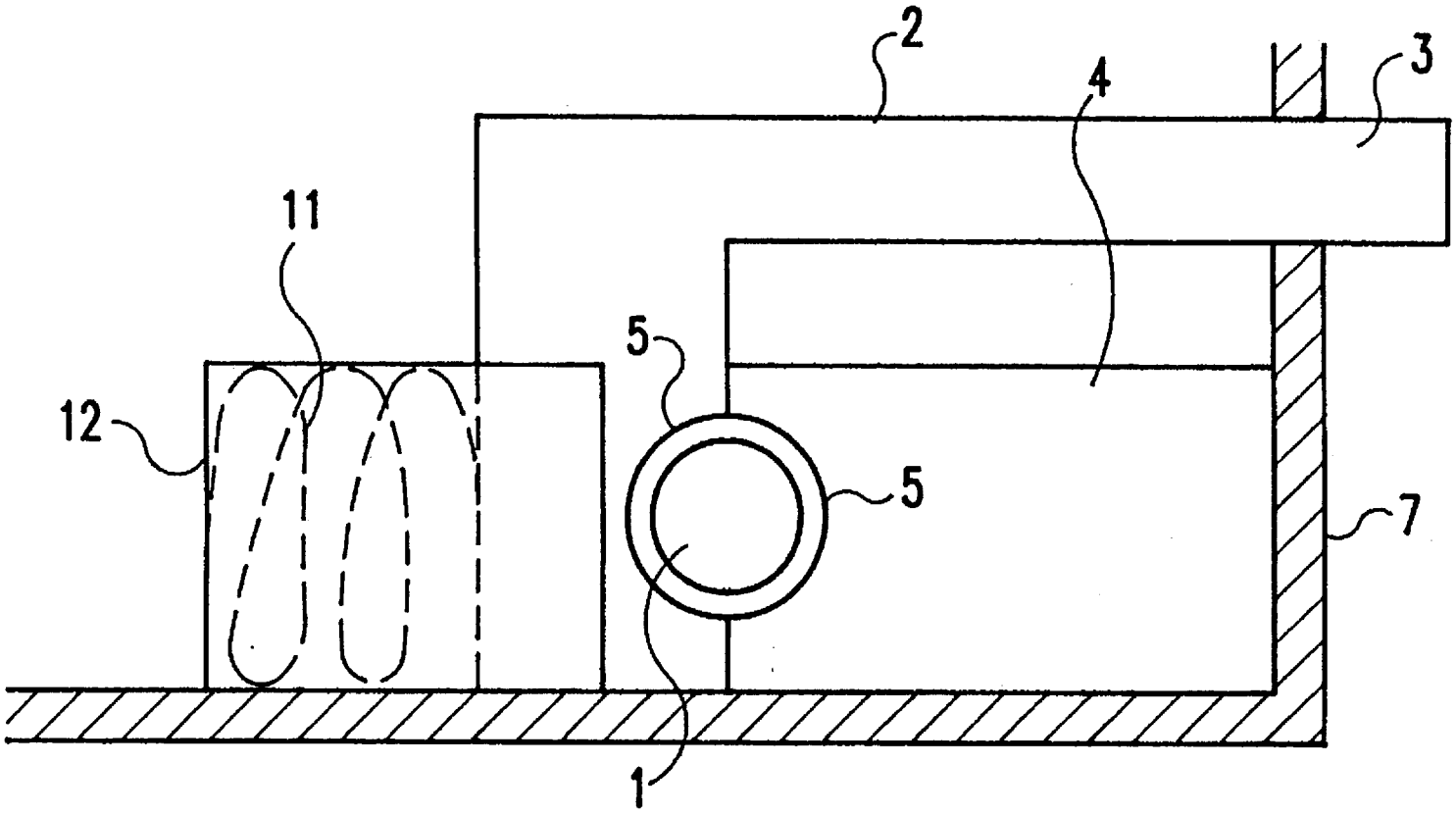
FIG. 2 is a section view along line I—I of FIG. 1 showing a retractable antenna locked in position by a movable contact and a locking portion.
Figure 3:
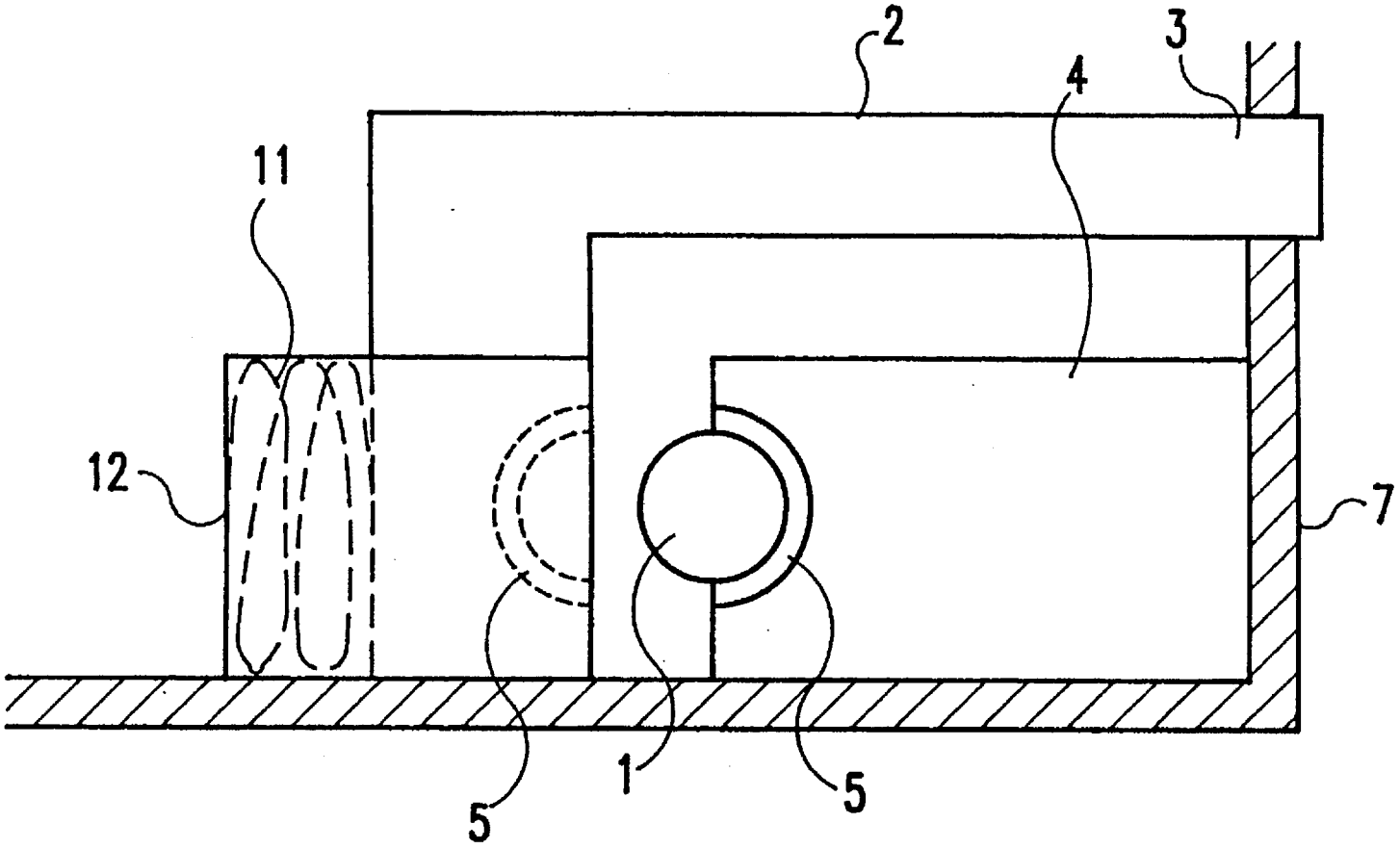
FIG. 3 is a view similar to FIG. 2, showing the antenna in an unlocked condition.
Figure 4:
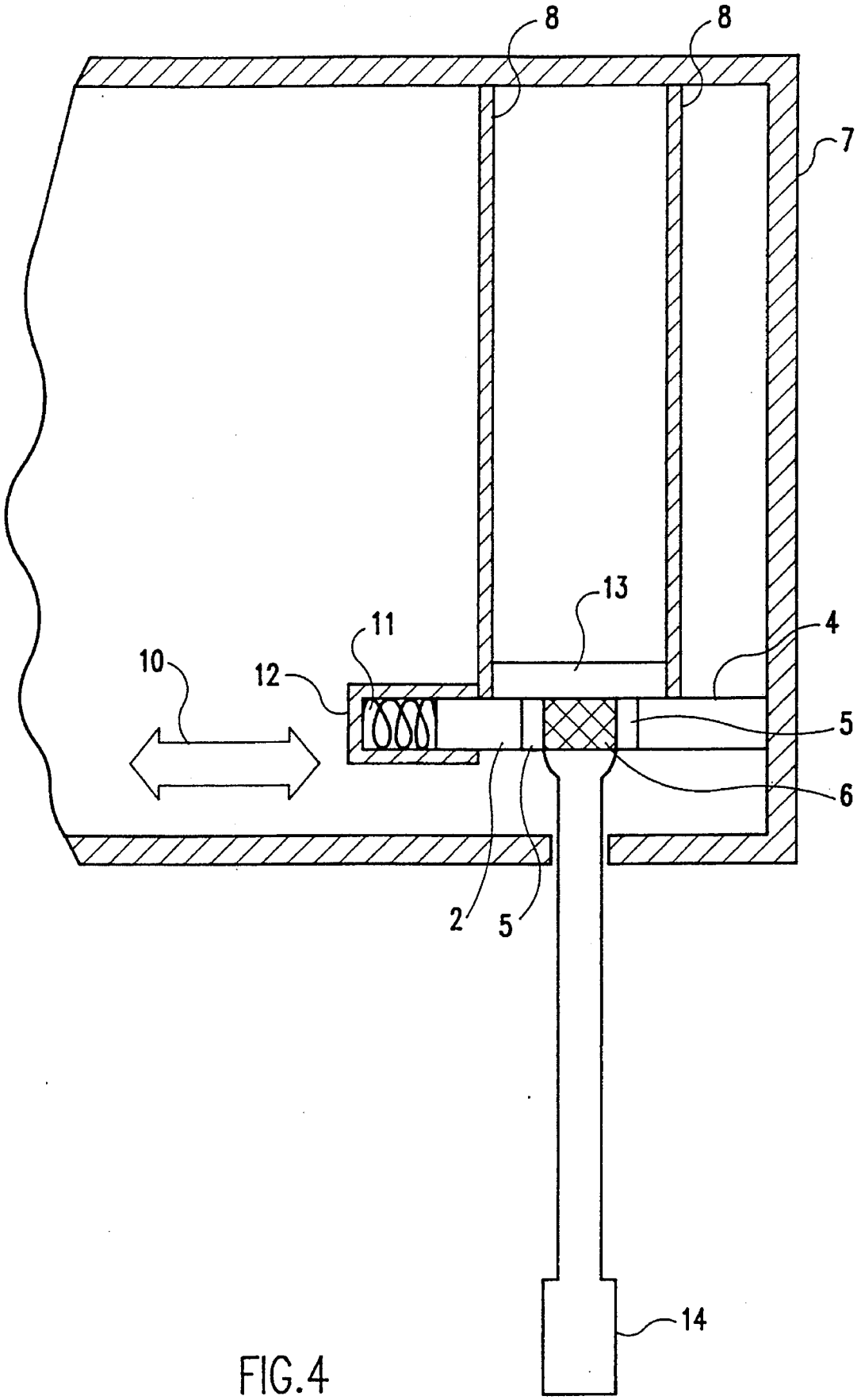
FIG. 4 is a section view along line II—II of FIG. 1.

How the antenna 1 is extended from and retracted into the casing 7 will be described with reference to FIGS. 2, 3 and 4. To extend the antenna 1 from the casing 7, the user of the apparatus holds the casing 7 with one hand and tilts it such that the antenna 1 will extend downward. Subsequently, as shown in FIG. 4, the user presses the operating portion 3 with, for example, the thumb or index finger of the hand holding the casing 7. As a result, the movable contact 2 is moved away from the locking portion 4 of the casing 7 to cause the antenna 1 to fall, i.e., extend from the casing 7 along the antenna guides 8 due to gravity. At this instant, the movable contact 2 moves to the left along the contact guide 12, as indicated by an arrow 10 in FIG. 4. The antenna 1 is provided with a flange 13, FIG. 4, at the innermost end thereof. The flange 13 abuts against the locking portion 4 of the casing 7, preventing the antenna 1 from slipping out of the casing 7.

When the antenna 1 is extended out until the flange 13 abuts against the locking portion 4, the user stops pressing the operating portion 3. In this condition, the movable contact 4 is held in contact with the feed point 6 of the antenna 1 due to the action of the spring 11, as shown in FIG. 2. Further, the antenna 1 is locked in the extended position by having the feed point 6 thereof held between the movable contact 2 and the locking portion 4.

To retract the antenna 1 into the casing 7, the user holds the casing 7 with one hand and tilts it such that the antenna 1 will be retracted into the casing 7 downward. Then, as the user presses the operating portion 3 with, for example, the thumb or index finger of the hand holding the casing 7, the antenna 1 is retracted into the casing 7 due to gravity, as shown in FIG. 3. As soon as the antenna 1 is fully retracted into the casing 7, the user stops pressing the operating portion 3. As a result, the tip 14 of the antenna 1, having the same diameter as the feed point 6, is held between the movable contact 2 and the locking portion 4, as shown in FIG. 2. In this condition, the antenna 1 is prevented from slipping out of the casing 7.

It should be noted that the antenna 1 has a conductor thereinside and has the surface thereof implemented by a nonconductor. Hence, the antenna 1 does not receive an electric field even when the tip 14 thereof is held between the movable contact 2 and the locking portion 4.

In summary, it will be seen that the present invention provides an antenna mounting structure which allows an antenna to be extended from and retracted into a casing by one since it has a movable contact, a portion for operating it, and a locking portion. When the antenna is extended from the casing, a flange provided on the end of the antenna abuts against the locking portion. This, coupled with the fact that antenna guides are provided in the casing, prevents the antenna from jumping out of the casing, thereby ensuring safety operation. In addition, such a structure prevents the antenna from slipping out of the casing.

Obviously, numerous additional modifications and variations of the present invention are possible in light of the above teachings. It is, therefore, to be understood that within the scope of the appended claims, the invention may be practiced otherwise than as specifically described herein.

What is claimed is:

1. A structure for mounting an antenna retractable in a casing, comprising:

feeding means provided on an innermost end of said antenna;

an openable movable contact for contacting said feeding means;

a resilient member for biasing said openable movable contact;

a locking portion for contacting said feeding means, said openable movable contact anal said locking portion holding said feeding means when said antenna is extended from said casing;

operating means connected to said openable movable contact for protruding said antenna from said casing; and antenna guides for guiding said antenna into and out of said casing by the weight of said antenna.

2. A structure as claimed in claim 1, wherein said openable movable contact is constantly biased by said resilient member.

3. A structure as claimed in claim 2, wherein said openable movable contact and said locking portion are each provided with an electrode.

4. A structure as claimed in claim 2, wherein said resilient member comprises a spring and a contact guide for guiding said openable movable contact.

5. A structure as claimed in claim 4, wherein said casing comprises a casing of a portable radio communication apparatus.

6. A structure as claimed in claim 2, wherein said locking portion locks said antenna by holding said feeding means.

7. A structure as claimed in claim 6, wherein said casing comprises a casing of a portable radio communication apparatus.

8. A structure as claimed in claim 1, wherein said antenna includes a flange provided on an inboard end of said feeding means.

9. A structure as claimed in claim 8, wherein an outermost end of said antenna has a same diameter as said feeding means.

10. A structure as claimed in claim 9, wherein said openable movable contact and said locking portion lock said antenna by holding said outermost end of said antenna.

11. A structure as claimed in claim 10, wherein said casing comprises a casing of a portable radio communication apparatus.

12. A structure as in claim 1, wherein said antenna retracts and extends solely by a gravitational force.

* * * * *